US010496122B1

(12) United States Patent
Gottapu et al.

(10) Patent No.: US 10,496,122 B1
(45) Date of Patent: Dec. 3, 2019

(54) REFERENCE VOLTAGE GENERATOR WITH REGULATOR SYSTEM

(71) Applicant: NXP USA, INC., Austin, TX (US)

(72) Inventors: Anil Kumar Gottapu, Vizianagaram (IN); Sanjay Kumar Wadhwa, Noida (IN); Ravi Dixit, Noida (IN)

(73) Assignee: NXP USA, INC., Austin, TX (US)

( * ) Notice: Subject to any disclaimer, the term of this patent is extended or adjusted under 35 U.S.C. 154(b) by 0 days.

(21) Appl. No.: 16/108,456

(22) Filed: Aug. 22, 2018

(51) Int. Cl.
*G05F 3/30* (2006.01)
*G05F 3/22* (2006.01)
*G05F 3/24* (2006.01)

(52) U.S. Cl.
CPC ..... *G05F 3/30* (2013.01); *G05F 3/225* (2013.01); *G05F 3/245* (2013.01)

(58) Field of Classification Search
CPC ..... G05F 1/465; G05F 1/567; G05F 3/225; G05F 3/245; G05F 3/267; G05F 3/30
See application file for complete search history.

(56) References Cited

U.S. PATENT DOCUMENTS 6,175,224 B1 1/2001 Kadanka
7,057,427 B2 6/2006 Wadhwa et al.
7,276,890 B1 * 10/2007 Kumar ..... G05F 3/30 323/313
8,816,756 B1 * 8/2014 Eberlein ..... G05F 3/30 327/539
9,030,186 B2 5/2015 Gupta et al.
9,654,096 B1 5/2017 Wadhwa et al.
2002/0047696 A1 * 4/2002 Chowdhury ..... G05F 3/30 323/316
2004/0119528 A1 * 6/2004 Rashid ..... G05F 3/225 327/538
2009/0302823 A1 * 12/2009 Chao ..... G05F 3/30 323/313
2010/0073070 A1 * 3/2010 Ng ..... G05F 3/30 327/513
2011/0074495 A1 * 3/2011 Duval ..... G05F 3/30 327/539
2014/0015509 A1 1/2014 Gupta et al.
2016/0018839 A1 * 1/2016 Cocetta ..... G05F 3/225 323/314

(Continued)

OTHER PUBLICATIONS

Wadhwa, S., "High accuracy, multi-output bandgap reference circuit in 16nm FinFet", 2017 30th International Conference on VLSI Design and 16th International Conference on Embedded Systems, IEEE 2016.

*Primary Examiner* — Fred E Finch, III

(57) ABSTRACT

An integrated circuit includes an output driver circuit configured to provide a first voltage at an output terminal. The output driver circuit includes a transistor having a first current electrode coupled at a voltage supply terminal and a second current electrode coupled at the output terminal, and a resistor having a first terminal coupled at the output terminal and a second terminal coupled at a first node. An amplifier circuit is coupled to the output driver circuit and is configured to generate a proportional to absolute temperature (PTAT) current in a first circuit branch of the output driver circuit coupled at the first node. A complementary to absolute temperature (CTAT) circuit is configured to generate a CTAT current in a second circuit branch coupled at the first node.

19 Claims, 3 Drawing Sheets

FIG. 2

(56) References Cited

U.S. PATENT DOCUMENTS

2016/0026204 A1* 1/2016 de Cremoux ..... G05F 3/08
323/314
2018/0307258 A1* 10/2018 Kadanka ..... G05F 1/567

* cited by examiner

REFERENCE VOLTAGE GENERATOR WITH REGULATOR SYSTEM

BACKGROUND

Field

This disclosure relates generally to semiconductor devices, and more specifically, to reference voltage generator with regulator systems in semiconductor devices.

Related Art

Today, it is important to include a stable reference voltage generator on an integrated circuit (IC) die, or chip. For example, circuits that provide a stable reference voltage are used in analog devices such as data converters, sensors, memories, and others. These circuits require voltage generators that are stable over manufacturing process variations, supply voltage variations, and operating temperature variations. Such voltage generators can be implemented without modifications of conventional manufacturing processes. A bandgap reference circuit is commonly used as a stable reference voltage generator circuit, typically providing a bandgap voltage operating point of 1.2 volts. However, generating a stable reference voltage other than 1.2 volts presents challenges.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

DETAILED DESCRIPTION

Bandgap voltage reference circuits are widely used in analog design to generate a stable voltage reference across an operating temperature range of a semiconductor integrated circuit (IC) device. The bandgap voltage reference typically includes a bandgap core having multiple resistors in combination with multiple transistors and a gain stage to generate the reference voltage equal to the bandgap voltage of the semiconductor material (e.g., 1.2 volts). Voltage regulators are generally coupled to bandgap voltage reference circuits to provide a constant voltage, independent of load current, for a predetermined range of load currents. However, the use of these two circuits in tandem as conventionally arranged is relatively expensive to implement from power and area considerations as the industry demands IC designs with ever decreasing power supplies and smaller area footprints. To provide a stable voltage reference higher than the bandgap voltage, additional circuitry further consumes power and impacts overall circuit area.

Generally, there is provided, a single amplifier reference voltage generator with regulator system that generates a regulated reference voltage (e.g., 1.4 volts) at an output which is higher than a bandgap voltage of 1.2 volts. The system includes a proportional to absolute temperature (PTAT) current generated by a $\Delta V_{BE}/R_{PTAT}$ arrangement in an output driver circuit. The generated PTAT current ($I_{PTAT}$) flows through a resistor stack and diode-connected transistor to generate the bandgap voltage. A complementary to absolute temperature (CTAT) current ($I_{CTAT}$) given by $V_{BE}/R_{CTAT}$ is generated in a CTAT circuit coupled to the output driver circuit. Both PTAT and CTAT currents flow through a resistor (R) of the output driver circuit coupled between the output and the first node forming a $(I_{PTAT}+I_{CTAT})*R$ voltage. The system, therefore, generates a regulated output voltage approximately equal to the bandgap voltage plus the $(I_{PTAT}+I_{CTAT})*R$ voltage.

Figure 1:
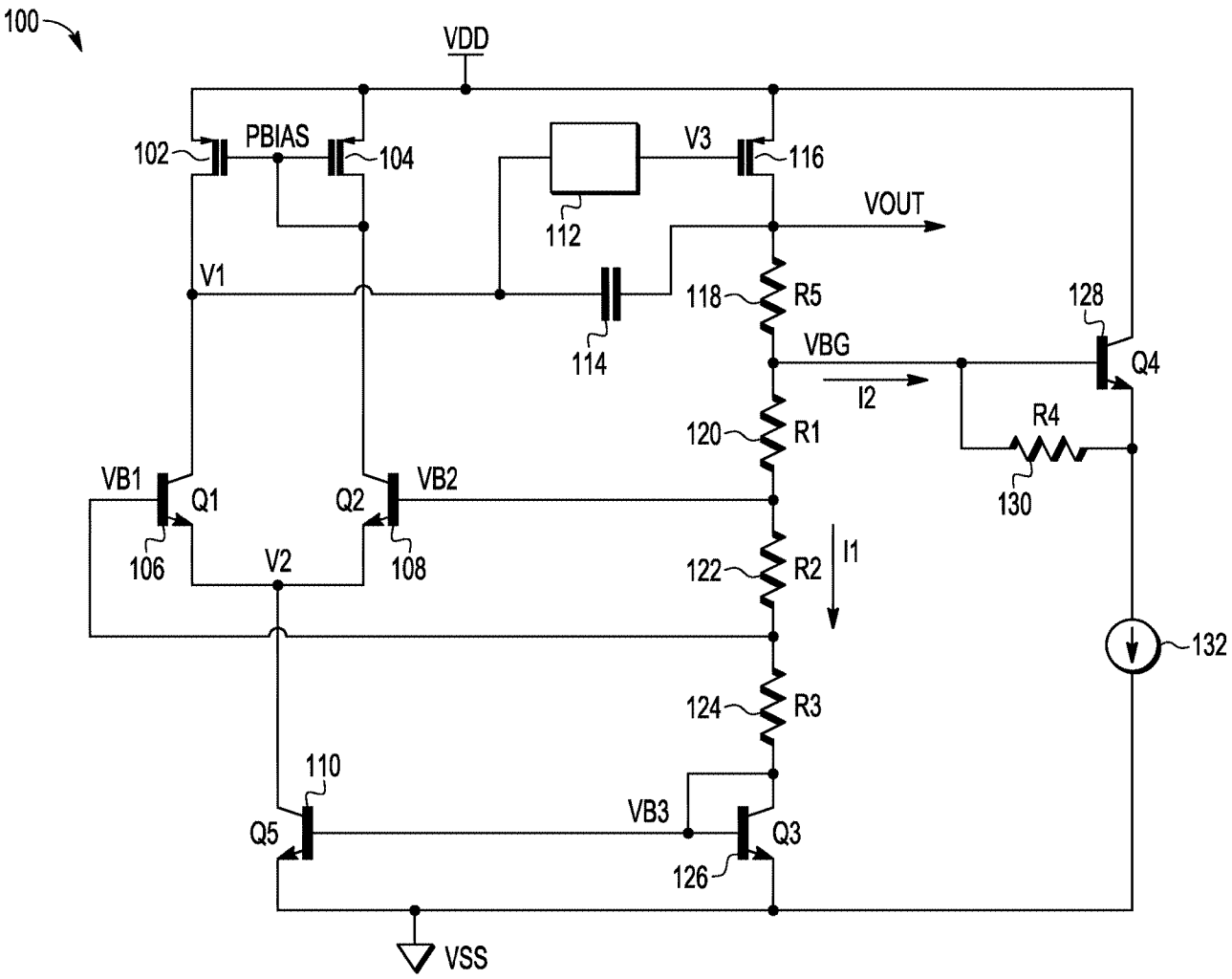
FIG. 1 illustrates, in schematic diagram form, an example reference voltage generator with regulator system in accordance with an embodiment of the present invention.

FIG. 1 illustrates, in schematic diagram form, an example reference voltage generator with regulator system 100 in accordance with an embodiment of the present invention. The system 100 is formed as a reference voltage generator and a voltage regulator incorporated together while using only one amplifier circuit. In this embodiment, system 100 includes an amplifier circuit, a level shifter circuit, a CTAT circuit, and an output driver circuit.

The amplifier circuit includes P-channel transistors 102, 104, and NPN bipolar junction transistors (BJTs) 106, 108, 110. Transistors 102 and 104 are configured to form a current mirror having a first current branch and a second current branch. In an embodiment, transistors 102 and 104 are formed having approximately the same size (e.g., 1:1 size ratio).

In other embodiments, transistors 102 and 104 may be formed to have other size ratios (e.g., 1:2 size ratio where transistor 104 is two times the size of transistor 102). A first current electrode of each of transistors 102 and 104 is coupled to a first voltage supply terminal (e.g., VDD). A second current electrode of transistor 102 is coupled to a first current electrode (e.g., collector) of transistor 106 (Q1) at node labeled V1 in the first current branch. A second current electrode of transistor 104 is coupled to control electrodes of transistors 102, 104 at node labeled PBIAS and a first current electrode (e.g., collector) of transistor 108 (Q2) in the second current branch. A second current electrode (e.g., emitter) of transistor 106 is coupled to a second current electrode (e.g., emitter) of transistor 108 and a first current electrode (e.g., collector) of transistor 110 (Q5) at node labeled V2. A second current electrode (e.g., emitter) of transistor 110 is coupled to a second voltage supply terminal (e.g., VSS). In an embodiment, a ratio of BJTs Q1 and Q2 emitter areas is 8:1, where the emitter area of BJT Q1 is eight times the emitter area of BJT Q2. In other embodiments, BJTs Q1 and Q2 may be formed to have other ratios between Q1 and Q2 emitter areas.

The output driver circuit is coupled to the amplifier circuit and is configured to provide a regulated output voltage VOUT at output labeled VOUT. The output driver circuit includes P-channel transistor 116, NPN BJT 126, and resistors 118-124. A first current electrode of transistor 116 is coupled to the first voltage supply terminal (e.g., VDD) and a second current electrode of transistor 116 is coupled to the VOUT output terminal and a first terminal of resistor 118 (R5). A second terminal of resistor 118 is coupled to a first terminal of resistor 120 (R1) at node labeled VBG. A second terminal of resistor 120 is coupled to a first terminal of resistor 122 (R2) and a control electrode (e.g., base) of transistor 108 at node labeled VB2. A second terminal of resistor 122 is coupled to a first terminal of resistor 124 (R3) and a control electrode (e.g., base) of transistor 106 at node labeled VB1. A second terminal of resistor 124 is coupled to a first current electrode (e.g., collector) of transistor 126 (Q3) and control electrodes (e.g., base) of transistors 110 and 126. A second current electrode (e.g., emitter) of transistor 126 is coupled to the second voltage supply terminal. In an embodiment, a ratio of BJTs Q3 and Q5 emitter areas is 1:2, where the emitter area of BJT Q5 is two times the emitter area of BJT Q3. In other embodiments, BJTs Q3 and Q5 may be formed to have other ratios between Q3 and Q5 emitter areas.

A PTAT current I1 is generated in a circuit branch coupled at node VBG including resistors 120-124 and transistor 126. The PTAT current is generated by the difference of voltages established at nodes VB2 and VB1 and applied across resistor 122 (e.g., PTAT current=$\Delta V_{BE}$(Q2, Q1)/R2). Although the driver transistor 116 is shown as a P-channel transistor, it will be appreciated that the transistor can take other forms (e.g., N-channel transistor).

The CTAT circuit is coupled to the output driver circuit and is configured to generate a CTAT current I2 in a circuit branch coupled at node VBG. The CTAT circuit includes NPN BJT 128, resistor 130, and current source 132. A first current electrode (e.g., collector) of transistor 128 (Q4) is coupled to the first voltage supply terminal. A control electrode (e.g., base) of transistor 128 is coupled to a first terminal of resistor 130 (R4) at node labeled VBG. A second terminal of resistor 130 is coupled to a second current electrode (e.g., emitter) of transistor 128 and a first terminal of current source 132. A second terminal of current source 132 is coupled at the second voltage supply terminal. Ignoring the base current ($I_B$) of Q4, the CTAT current I2 is generated by the $V_{BE}$ voltage of transistor 128 applied across resistor 130 (e.g., $V_{BE}$(Q4)/R4). In an embodiment, a ratio of BJTs Q2 and Q4 emitter areas of is 1:1, where the emitter area of BJT Q4 is approximately the same as the emitter area of BJT Q2. In other embodiments, BJTs Q2 and Q4 may be formed to have other ratios between Q2 and Q4 emitter areas.

The level shifter circuit 112 is coupled between the amplifier circuit and the output driver circuit. The level shifter circuit 112 includes an input coupled to node V1 of the amplifier circuit and an output coupled to a control electrode (e.g., gate) of transistor 116 at node labeled V3. The level shifter circuit 112 provides a voltage V3 at the control electrode of transistor 116 such that a desired VOUT voltage is generated. In addition, a capacitor 114 is coupled between the amplifier circuit and the output driver circuit. A first terminal of capacitor 114 is coupled at node V1 of the amplifier circuit and a second terminal of capacitor 114 is coupled at node VOUT of the output driver circuit. The capacitor 114 is configured to provide stability to the system 100.

In operation, a nominal VDD operating voltage of 1.8 volts is provided at the first voltage supply terminal and a nominal VSS operating voltage of 0 volts or ground voltage is provided at the second voltage supply terminal. The PTAT current I1 is generated by a voltage difference (e.g., $\Delta V_{BE}$=VB2−VB1) applied across resistor 122 in the circuit branch of the output driver circuit coupled at node VBG and the CTAT current I2 is generated by the $V_{BE}$ voltage of transistor 128 applied across resistor 130 in the CTAT circuit branch coupled at node VBG. The bandgap voltage VBG at node VBG is generated based on the PTAT current I1 flowing through the resistor stack (e.g., resistors 120-124) and transistor 126. The bandgap voltage VBG is given by: VBG=$V_{BE}$(Q3)+(R1+R2+R3)/R2*$\Delta V_{BE}$. In an embodiment, the VBG is approximately 1.2 volts. Because the PTAT and CTAT currents both flow through resistor 118, the VOUT voltage (e.g., VOUT=VBG+(I1+I2)*R5) is substantially higher than the VBG voltage. In an embodiment, the VOUT voltage is approximately 1.4 volts where (I1+I2)*R5=0.2 volts. In other embodiments, the system 100 may be configured to provide lower or higher VOUT voltages.

Figure 2:
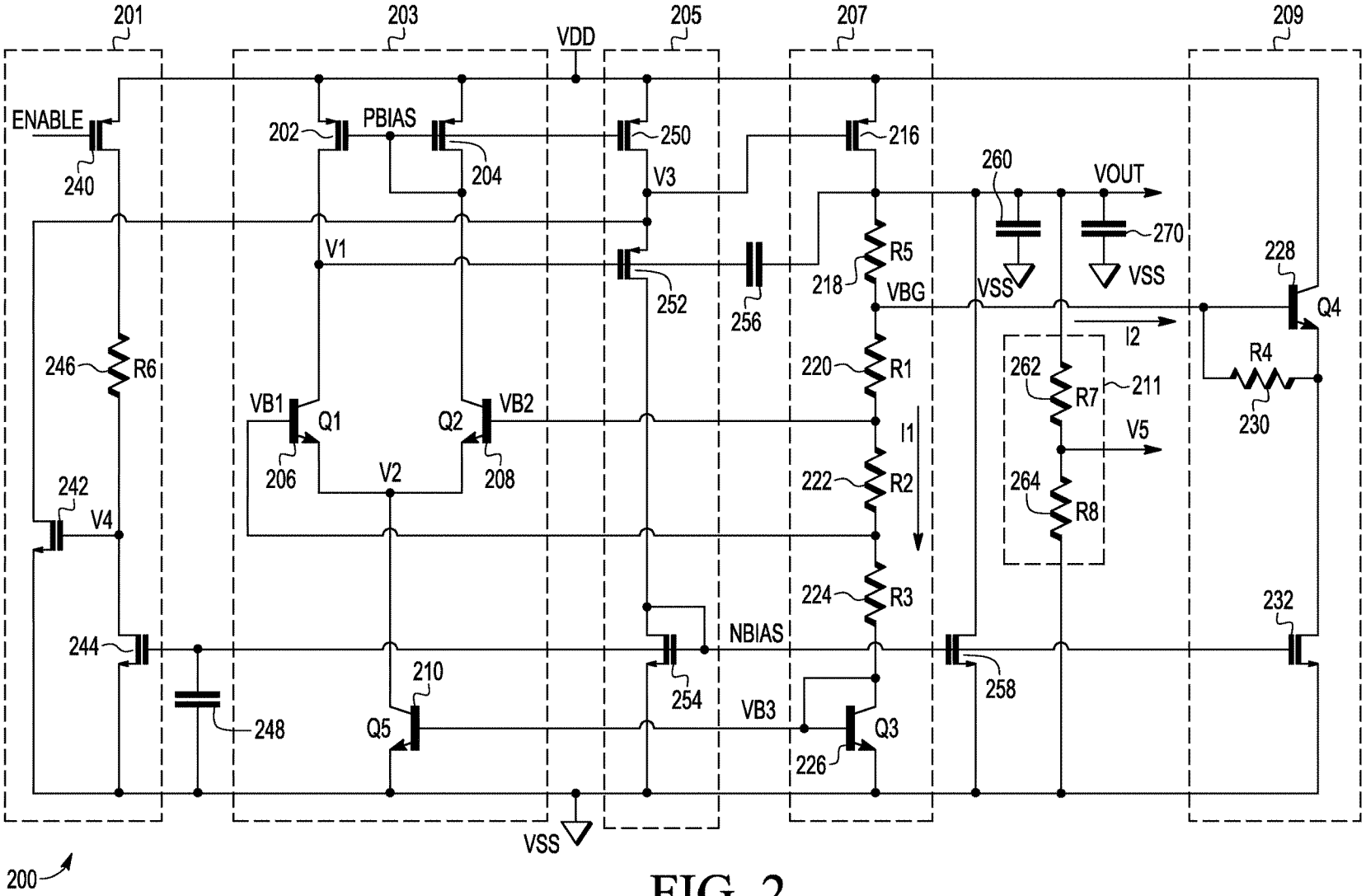
FIG. 2 illustrates, in schematic diagram form, a more detailed example reference voltage generator with regulator system in accordance with an embodiment of the present invention.

FIG. 2 illustrates, in schematic diagram form, a more detailed example reference voltage generator with regulator system 200 in accordance with an embodiment of the present invention. The system 200 is formed as a reference voltage generator and a voltage regulator incorporated together while using only one amplifier circuit. In this embodiment, system 200 includes a startup circuit 201, an amplifier circuit 203, a level shifter circuit 205, an output driver circuit 207, a CTAT circuit 209, and a divider circuit 211.

The amplifier circuit 203 includes P-channel transistors 202, 204, and NPN BJTs 206-210. Transistors 202 and 204 are configured to form a current mirror having a first current branch and a second current branch. In an embodiment, transistors 202 and 204 are formed having approximately the same size (e.g., 1:1 size ratio) such that a current in the first branch is approximately equal to a current in the second branch. In other embodiments, transistors 202 and 204 may be formed to have other size ratios. A first current electrode of each of transistors 202 and 204 is coupled to a first voltage supply terminal (e.g., VDD). A second current electrode of transistor 202 is coupled to a first current electrode (e.g., collector) of transistor 206 (Q1) at node labeled V1 in the first current branch. A second current electrode of transistor 204 is coupled to control electrodes of transistors 202, 204, and a first current electrode (e.g., collector) of transistor 208 (Q2) at node labeled PBIAS in the second current branch. Here, transistor 204 is configured to generate a bias voltage PBIAS at node PBIAS. A second current electrode (e.g., emitter) of transistor 206 is coupled to a second current electrode (e.g., emitter) of transistor 208 and a first current electrode (e.g., collector) of transistor 210 at node labeled V2. A second current electrode (e.g., emitter) of transistor 210 is coupled to a second voltage supply terminal (e.g., VSS). In an embodiment, a ratio of BJTs Q1 and Q2 emitter areas is 8:1, where the emitter area of BJT Q1 is eight times the emitter area of BJT Q2. In other embodiments, BJTs Q1 and Q2 may be formed to have other ratios between Q1 and Q2 emitter areas.

The output driver circuit 207 is coupled to the amplifier circuit 203 and is configured to provide an output voltage VOUT at output labeled VOUT. The output driver circuit includes P-channel transistor 216, NPN BJT 226, and resistors 218-224. A first current electrode of transistor 216 is coupled to the first voltage supply terminal and a second current electrode of transistor 216 is coupled to the VOUT output terminal and a first terminal of resistor 218 (R5). A second terminal of resistor 218 is coupled to a first terminal of resistor 220 (R1) at node labeled VBG. A second terminal of resistor 220 is coupled to a first terminal of resistor 222 (R2) and a control electrode (e.g., base) of transistor 208 at node labeled VB2. A second terminal of resistor 222 is coupled to a first terminal of resistor 224 (R3) and a control electrode (e.g., base) of transistor 206 at node labeled VB1. A second terminal of resistor 224 is coupled to a first current electrode (e.g., collector) of transistor 226 and control electrodes (e.g., base) of transistors 210 and 226. A second current electrode (e.g., emitter) of transistor 226 is coupled to the second voltage supply terminal.

A PTAT current is generated in the circuit branch coupled at node VBG including resistors 220-224 and transistor 226. The PTAT current is generated by the difference of voltages established at nodes VB2 and VB1 and applied across resistor 222 (e.g., PTAT current=$\Delta V_{BE}$(Q2, Q1)/R2). In an embodiment, a ratio of BJTs Q3 and Q5 emitter areas is 1:2, where the emitter area of BJT Q5 is two times the emitter area of BJT Q3. In other embodiments, BJTs Q3 and Q5 may be formed to have other ratios between Q3 and Q5 emitter areas.

The CTAT circuit 209 is coupled to the output driver circuit 207 and is configured to generate a CTAT current in the circuit branch coupled at node VBG. The CTAT circuit includes NPN BJT 228, resistor 230, and current source 232. A first current electrode (e.g., collector) of transistor 228 is coupled to the first voltage supply terminal. A control electrode (e.g., base) of transistor 228 is coupled to a first terminal of resistor 230 (R4) at node labeled VBG. A second terminal of resistor 230 is coupled to a second current electrode (e.g., emitter) of transistor 228 and a first terminal of current source 232. A second terminal of current source 232 is coupled at the second voltage supply terminal. The CTAT current is generated by the $V_{BE}$ voltage of transistor 228 applied across resistor 230 (e.g., $V_{BE}$(Q4)/R4), ignoring the base current ($I_B$) of transistor 228. In an embodiment, a ratio of BJTs Q2 and Q4 emitter areas is 1:1, where the emitter area of BJT Q4 is approximately the same as the emitter area of BJT Q2. In other embodiments, BJTs Q2 and Q4 may be formed to have other ratios between Q2 and Q4 emitter areas.

The level shifter circuit 205 is coupled between the amplifier circuit 203 and the output driver circuit 207. The level shifter circuit 205 includes P-channel transistors 250, 252 and N-channel transistor 254 arranged in series between the first voltage supply terminal and the second voltage supply terminal. A first current electrode of transistor 250 is coupled to the first voltage supply terminal and a second current electrode of transistor 250 is coupled to a control electrode (e.g., gate) of transistor 216 of the output driver circuit 207 and a first current electrode of transistor 252 at node labeled V3. A control electrode of transistor 250 is coupled to receive bias voltage PBIAS at node PBIAS, and a control electrode of transistor 252 is coupled to node V1. A second current electrode of transistor 252 is coupled to a first current electrode and a control electrode of transistor 254 at node labeled NBIAS. Here, transistor 254 is configured to generate a bias voltage NBIAS at node NBIAS. A second current electrode of transistor 254 is coupled to the second voltage supply terminal. In addition, a capacitor 256 is coupled between the amplifier circuit 203 and the output driver circuit 207. A first terminal of capacitor 256 is coupled at node V1 and a second terminal of capacitor 256 is coupled at node VOUT. The capacitor 256 is configured to provide stability to the system 200 as well as ensure high unity-gain bandwidth.

The startup circuit 201 is coupled to the level shifter circuit 205 and the output driver circuit 207 at node V3. The startup circuit 201 is enabled by way of a control signal labeled ENABLE. For example, when the ENABLE signal is in a first state (e.g., logic low level), the startup circuit 201 is enabled, and when the ENABLE signal is at a second state (e.g., logic high level), the startup circuit 201 is disabled. The startup circuit 201 includes P-channel transistor 240, N-channel transistors 242, 244, and resistor 246. A first current electrode of transistor 240 is coupled to the first voltage supply terminal, a second current electrode of transistor 240 is coupled to a first terminal of resistor 246 (R6), and a control electrode of transistor 240 is coupled to receive the ENABLE control signal. A second terminal of resistor 246 is coupled to a control electrode of transistor 242 and a first current electrode of transistor 244 at node labeled V4. A control electrode of transistor 244 is coupled to receive bias voltage NBIAS at node NBIAS and a second current electrode of transistor 244 is coupled to the second voltage supply terminal. A first current electrode of transistor 242 is coupled at node V3 and a second current electrode of transistor 242 is coupled at the second voltage supply terminal. In addition, a capacitor 248 is coupled to the startup circuit 201. A first terminal of capacitor 248 is coupled at node NBIAS and a second terminal of capacitor 248 is coupled at the second voltage supply terminal.

The divider circuit 211 is coupled to the output node VOUT and configured to provide a second output voltage V5 at node labeled V5 which is lower than the VOUT voltage. The divider circuit 211 includes resistors 262, 264 coupled in series between node VOUT and the second voltage supply terminal (e.g., VSS). A first terminal of resistor 262 (R7) is coupled to node VOUT and a second terminal of resistor 262 is coupled to a first terminal of resistor 264 (R8) at second output voltage node V5. A second terminal of resistor 264 is coupled to the second voltage supply terminal. In this embodiment, the second output voltage V5 is provided by way of a resistor divider where V5=VOUT*R8/(R7+R8). In other embodiments, other voltage dividers may be employed to provide other output voltages derived from VOUT.

In addition, an N-channel transistor 258, a decoupling capacitor 260, and load capacitance 270 (e.g., shown as capacitor 270) are coupled at the output node VOUT. A first current electrode of transistor 258 is coupled to the VOUT node and a second current electrode of transistor 258 is coupled to the second voltage supply terminal (e.g., VSS). A control electrode of transistor 258 is coupled at node NBIAS to receive bias voltage NBIAS. A first terminal of decoupling capacitor 260 is coupled at node VOUT and a second terminal of decoupling capacitor 260 is coupled at the second voltage supply terminal. In an embodiment, the decoupling capacitor 260 has a value of approximately 500 pF and is arranged to help reduce high switching load transients. In other embodiments, the decoupling capacitor 260 may have other capacitance values. A first terminal of load capacitance 270 is coupled at node VOUT and a second terminal of load capacitance 270 is coupled at the second voltage supply terminal. The load capacitance 270 may be representative of lump capacitive loading associated with circuitry coupled to node VOUT.

In operation, a VDD voltage is provided at the first voltage supply terminal and a VSS voltage of 0 volts or ground voltage is provided at the second voltage supply terminal. As VDD ramps up (e.g., during power-up with ENABLE signal at a logic low level or tied to VSS), the enabled startup circuit 201 pulls down node V3 so that the self-biased circuitry (e.g., VB3, transistor 226) can start. Because transistors 226 and 210 are configured in a current mirror arrangement, current begins to flow in each of transistors 226 and 210. After VDD ramps up, VDD is at a nominal operating voltage of 1.8 volts. The PTAT current I1 is generated by a voltage difference (e.g., $\Delta V_{BE}$=VB2−VB1) applied across resistor 222 in the circuit branch of the output driver circuit 207 coupled at node VBG, and the CTAT current I2 (ignoring base current ($I_B$) of Q4) is generated by the $V_{BE}$ voltage of transistor 228 applied across resistor 230 in the CTAT circuit branch coupled at node VBG. The bandgap voltage VBG at node VBG is generated based on the PTAT current I1 flowing through the resistor stack (e.g., resistors 220-224) and transistor 226. In an embodiment, the VBG is approximately 1.2 volts. Because the PTAT and CTAT currents both flow through resistor 218, the VOUT voltage is substantially higher than the VBG voltage. In an embodiment, the VOUT voltage is approximately 1.4 volts where (I1+I2)*R5=0.2 volts. In other embodiments, the system 200 may be configured to provide other VOUT voltages (e.g., VOUT approximately equal to 1.3 volts with (I1+I2)*R5=0.1 volts).

In the embodiment of FIG. 2, a $\Delta V_{BE}$ voltage is generated between transistors 208 (Q2) and 206 (Q1). The $\Delta V_{BE}$ voltage is applied across resistor 222 (R2) to generate the PTAT current $I_{PTAT}$ (I1). The $I_{PTAT}$ current I1 is given by:

$$I_{PTAT} = \frac{\Delta V_{BE}}{R2}$$

where $$\Delta V_{BE} = VB2 - VB1.$$

The VBG voltage is given by:

$$VBG = V_{BE}(Q3) + \frac{(R1 + R2 + R3)}{R2}\Delta V_{BE}.$$

The bandgap voltage VBG is applied to transistor 228 (Q4) to generate a $V_{BE}$(Q4) voltage across resistor 230 (R4). The $V_{BE}$(Q4) voltage across R4 generates the CTAT current $I_{CTAT}$. Ignoring the base current ($I_B$) of Q4, $$I2 \approx I_{CTAT},$$

and the current flowing through R4 ($I_{CTAT}$) is given by:

$$I_{CTAT} = \frac{V_{BE}(Q4)}{R4}.$$

Both $I_{PTAT}$ and $I_{CTAT}$ currents flow through resistor 218 (R5). Accordingly, the regulated output voltage VOUT is given by:

$$VOUT = VBG + \left(\frac{\Delta V_{BE}}{R2} + \frac{V_{BE}(Q4)}{R4}\right)R5.$$

Figure 3:
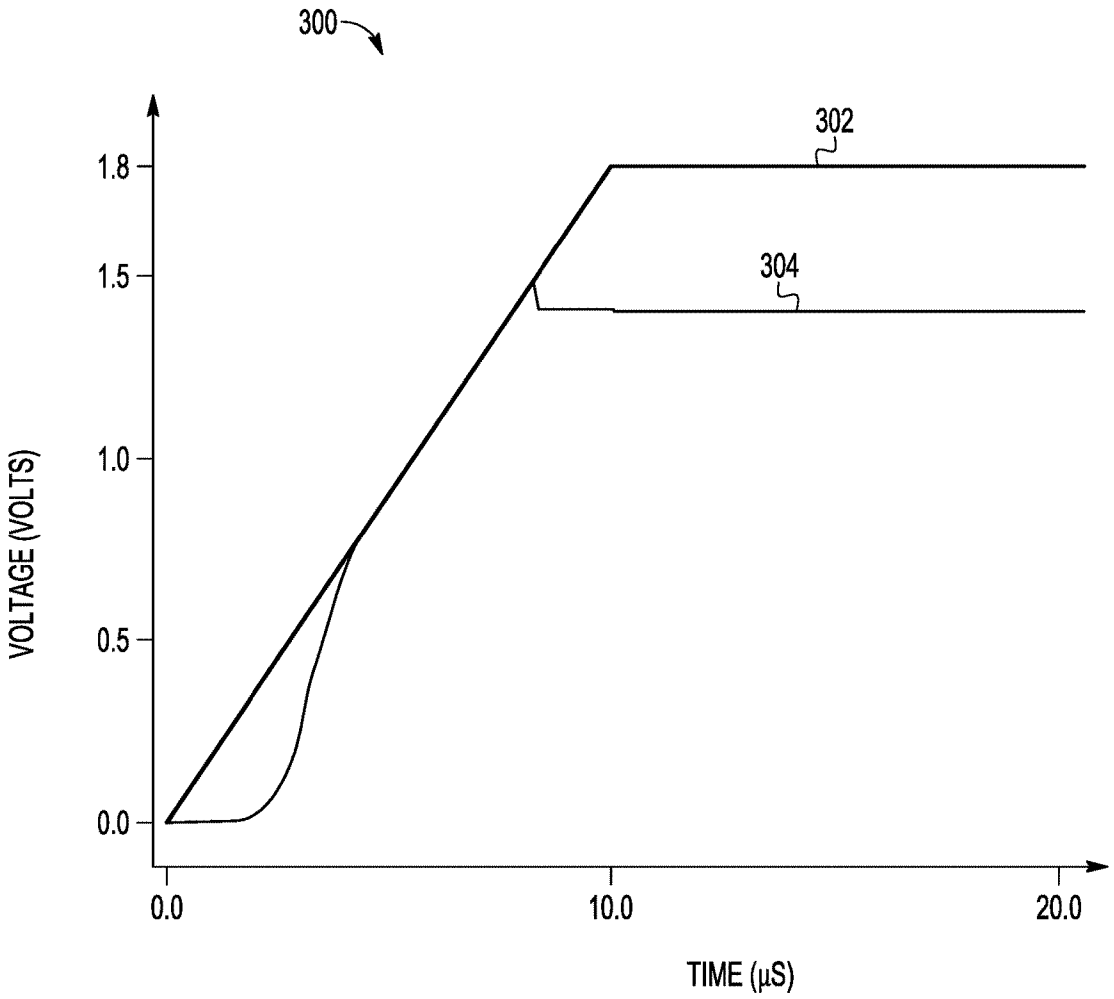
FIG. 3 illustrates, in plot diagram form, example reference voltage generator with regulator system voltage ramp-up versus time in accordance with an embodiment of the present invention.

FIG. 3 illustrates, in plot diagram form, example reference voltage generator with regulator system voltage ramp-up versus time in accordance with an embodiment of the present invention. Time values are shown in microseconds (μS) on the X-axis, and voltage values are shown in volts on the Y-axis. Plot diagram 300 includes waveforms 302 and 304 depicting simulation results of system 200 startup (e.g., power-up with ENABLE at logic low level or tied to VSS). In this example, plot 302 shows the VDD voltage ramping up to a normal operating value of 1.8 volts over an approximate 10.0 μS time period. Plot 304 shows a VOUT voltage response corresponding to VDD voltage values during startup. After VDD approaches about 0.8 volts, the VOUT voltage according to plot 304 tracks the VDD voltage until VDD reaches approximately 1.5 volts. When VDD reaches 1.8 volts, the VOUT voltage settles at the desired output voltage of approximately 1.4 volts. While system 200 is operating with VDD at the normal operating voltage of 1.8 volts, the VOUT voltage is regulated at the desired output voltage of 1.4 volts.

Generally, there is provided, an integrated circuit including an output driver circuit configured to provide a first voltage at a first output terminal, the output driver circuit includes a first transistor having a first current electrode coupled at a first voltage supply terminal and a second current electrode coupled at the first output terminal; and a first resistor having a first terminal coupled at the first output terminal and a second terminal coupled at a first node; an amplifier circuit coupled to the output driver circuit, the amplifier circuit configured to generate a proportional to absolute temperature (PTAT) current in a first circuit branch of the output driver circuit coupled at the first node; and a complementary to absolute temperature (CTAT) circuit configured to generate a CTAT current in a second circuit branch coupled at the first node. The first voltage may be based on the PTAT current and the CTAT current through the first resistor, and wherein the output driver circuit may be configured such that the first voltage is higher than a bandgap voltage generated at the first node. The CTAT circuit may include a first bipolar junction transistor (BJT) having a first current electrode coupled at the first voltage supply terminal and a control electrode coupled at the first node; and a second resistor having a first terminal coupled at the control terminal of the first BJT and a second terminal coupled at a second current electrode of the first BJT. The amplifier circuit may include a current mirror having a first current branch and a second current branch; a first BJT having a first current electrode coupled at the first current branch of the current mirror; and a second BJT having a first current electrode coupled at the second current branch of the current mirror and a second current electrode coupled to a second current electrode of the first BJT. The first circuit branch of the output driver circuit may include a second resistor having a first terminal coupled at the first node and at a second node, a second terminal coupled to a control electrode of the second BJT of the amplifier circuit; and a third resistor having a first terminal coupled at the second node and at a third node, a second terminal coupled to a control electrode of the first BJT of the amplifier circuit. The amplifier circuit may further include a third BJT having a first current electrode coupled to the second current electrodes of the first BJT and the second BJT, and a second current electrode coupled at a second voltage supply terminal, and wherein the output driver circuit further includes a fourth BJT having a first current electrode coupled to a control electrode and a second current electrode coupled at the second voltage supply terminal, the fourth BJT configured to form a current mirror with the third BJT. The first BJT may be configured to have an emitter area eight times the emitter area of the second BJT. The integrated circuit may further include a level-shifter circuit coupled to the amplifier circuit and to the output driver circuit, the level-shifter circuit including a second transistor having a first current electrode coupled at the first voltage supply terminal, a control electrode coupled to receive a first bias voltage from the amplifier circuit, and a second current electrode coupled to a control electrode of the first transistor of the output driver circuit. The level-shifter circuit may further include a third transistor configured to generate a second bias voltage, and wherein the CTAT circuit may include a fourth transistor coupled to receive the second bias voltage at a control electrode.

In another embodiment, there is provided, an integrated circuit including an output driver circuit configured to provide a first voltage at a first output terminal and a bandgap voltage at a first node, the output driver circuit includes a first transistor having a first current electrode coupled at a first voltage supply terminal and a second current electrode coupled at the first output terminal; and a first resistor having a first terminal coupled at the first output terminal and a second terminal coupled at the first node; an amplifier circuit coupled to the output driver circuit, the amplifier circuit configured to generate a PTAT current in a circuit branch of the output driver circuit; and a CTAT circuit coupled at the first node and configured to generate a CTAT current, the first voltage based on the PTAT current and the CTAT current through the first resistor. The output driver circuit may be configured such that the first voltage is higher than the bandgap voltage. The circuit branch of the output driver circuit includes a second resistor having a first terminal coupled at the first node, and wherein the amplifier circuit includes a first BJT having a control electrode coupled to a second terminal of the second resistor. The amplifier circuit may further include a second BJT having a first current electrode coupled to a first current electrode of the first BJT and a second current electrode coupled at a second voltage supply terminal, and wherein the circuit branch of the output driver circuit further includes a third BJT having a first current electrode and a control electrode coupled to a control electrode of the second BJT and a second current electrode coupled to the second voltage supply terminal. The amplifier circuit may further include a current mirror including a first current branch and a second current branch, a first current electrode of the first BJT coupled at the first current branch; and a second BJT having a first current electrode coupled at the second current branch of the current mirror and a second current electrode coupled to a second current electrode of the first BJT. The integrated circuit may further include a level-shifter circuit coupled to the amplifier circuit and to the output driver circuit, the level-shifter circuit including a second transistor having a first current electrode coupled at the first voltage supply terminal, a control electrode coupled to receive a first bias voltage from the amplifier circuit, and a second current electrode coupled to a control electrode of the first transistor of the output driver circuit. The level-shifter circuit may further include a third transistor configured to generate a second bias voltage, and wherein the CTAT circuit includes a fourth transistor coupled to receive the second bias voltage at a control electrode. The CTAT circuit may further include a first BJT having a first current electrode coupled at the first voltage supply terminal and a control electrode coupled at the first node; and a second resistor having a first terminal coupled at the control electrode of the first BJT and a second terminal coupled at a second current electrode of the first BJT and a first current electrode of the fourth transistor.

In yet another embodiment, there is provided, an integrated circuit including an output driver circuit configured to provide a first voltage at a first output terminal and a bandgap voltage at a first node, the output driver circuit including a first transistor having a first current electrode coupled at a first voltage supply terminal and a second current electrode coupled at the output terminal; and a first resistor having a first terminal coupled at the first output terminal and a second terminal coupled at the first node; an amplifier circuit coupled to the output driver circuit, the amplifier circuit configured to generate a $\Delta V_{BE}$ voltage across a second resistor to form a PTAT current in a current branch of the output driver circuit; and a CTAT circuit coupled at the first node and configured to generate a CTAT current, the first voltage based on the PTAT current and the CTAT current through the first resistor. The output driver circuit may be configured such that the first voltage is at least 100 mV higher than the bandgap voltage. The integrated circuit may further include a level-shifter circuit coupled to the amplifier circuit and to the output driver circuit, the level-shifter circuit including a second transistor having a first current electrode coupled at the first voltage supply terminal, a control electrode coupled to receive a first bias voltage from the amplifier circuit, and a second current electrode coupled to a control electrode of the first transistor of the output driver circuit.

By now it should be appreciated that there has been provided, a single amplifier reference voltage generator with regulator system that generates a regulated reference voltage (e.g., 1.4 volts) at an output which is higher than a bandgap voltage of 1.2 volts. The system includes a proportional to absolute temperature (PTAT) current generated by a $\Delta V_{BE}/R_{PTAT}$ arrangement in an output driver circuit. The generated PTAT current ($I_{PTAT}$) flows through a resistor stack and diode-connected transistor to generate the bandgap voltage. A complementary to absolute temperature (CTAT) current ($I_{CTAT}$) given by $V_{BE}/R_{CTAT}$ is generated in a CTAT circuit coupled to the output driver circuit. Both PTAT and CTAT currents flow through a resistor (R) of the output driver circuit coupled between the output and the first node forming a $(I_{PTAT}+I_{CTAT})*R$ voltage. The system, therefore, generates a regulated output voltage approximately equal to the bandgap voltage plus the $(I_{PTAT}+I_{CTAT})*R$ voltage.

Because the apparatus implementing the present invention is, for the most part, composed of electronic components and circuits known to those skilled in the art, circuit details will not be explained in any greater extent than that considered necessary as illustrated above, for the understanding and appreciation of the underlying concepts of the present invention and in order not to obfuscate or distract from the teachings of the present invention.

Although the invention has been described with respect to specific conductivity types or polarity of potentials, skilled artisans appreciated that conductivity types and polarities of potentials may be reversed.

Moreover, the terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

Architectures depicted herein are merely exemplary, and that in fact many other architectures can be implemented which achieve the same functionality. In an abstract, but still definite sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

Furthermore, those skilled in the art will recognize that boundaries between the functionality of the above described operations are merely illustrative. The functionality of multiple operations may be combined into a single operation, and/or the functionality of a single operation may be distributed in additional operations. Moreover, alternative embodiments may include multiple instances of a particular operation, and the order of operations may be altered in various other embodiments.

Although the invention is described herein with reference to specific embodiments, various modifications and changes can be made without departing from the scope of the present invention as set forth in the claims below. Accordingly, the specification and figures are to be regarded in an illustrative rather than a restrictive sense, and all such modifications are intended to be included within the scope of the present invention. Any benefits, advantages, or solutions to problems that are described herein with regard to specific embodiments are not intended to be construed as a critical, required, or essential feature or element of any or all the claims.

Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles.

Unless stated otherwise, terms such as "first" and "second" are used to arbitrarily distinguish between the elements such terms describe. Thus, these terms are not necessarily intended to indicate temporal or other prioritization of such elements.

What is claimed is:

1. An integrated circuit comprising:

an output driver circuit configured to provide a first voltage at a first output terminal, the output driver circuit comprising:

a first transistor having a first current electrode coupled at a first voltage supply terminal and a second current electrode coupled at the first output terminal; and a first resistor having a first terminal coupled at the first output terminal and a second terminal coupled at a first node;

an amplifier circuit coupled to the output driver circuit, the amplifier circuit configured to generate a proportional to absolute temperature (PTAT) current in a first circuit branch of the output driver circuit coupled at the first node;

a complementary to absolute temperature (CTAT) circuit configured to generate a CTAT current in a second circuit branch coupled at the first node; and a level-shifter circuit coupled to the amplifier circuit and to the output driver circuit, the level-shifter circuit comprising:

a second transistor having a first current electrode coupled at the first voltage supply terminal, a control electrode coupled to receive a first bias voltage from the amplifier circuit, and a second current electrode coupled to a control electrode of the first transistor of the output driver circuit; and a third transistor configured to generate a second bias voltage, and wherein the CTAT circuit comprises a fourth transistor coupled to receive the second bias voltage at a control electrode.

2. The integrated circuit of claim 1, wherein the first voltage is based on the PTAT current and the CTAT current through the first resistor, and wherein the output driver circuit is configured such that the first voltage is higher than a bandgap voltage generated at the first node.

3. The integrated circuit of claim 1, wherein the CTAT circuit comprises:

a first bipolar junction transistor (BJT) having a first current electrode coupled at the first voltage supply terminal and a control electrode coupled at the first node; and a second resistor having a first terminal coupled at the control terminal of the first BJT and a second terminal coupled at a second current electrode of the first BJT.

4. The integrated circuit of claim 1, wherein the amplifier circuit comprises:

a current mirror comprising a first current branch and a second current branch;

a first BJT having a first current electrode coupled at the first current branch of the current mirror; and a second BJT having a first current electrode coupled at the second current branch of the current mirror and a second current electrode coupled to a second current electrode of the first BJT.

5. The integrated circuit of claim 4, wherein the first circuit branch of the output driver circuit comprises:

a second resistor having a first terminal coupled at the first node and a second terminal coupled to a control electrode of the second BJT of the amplifier circuit at a second node; and a third resistor having a first terminal coupled at the second node and a second terminal coupled to a control electrode of the first BJT of the amplifier circuit at a third node.

6. The integrated circuit of claim 4, wherein the amplifier circuit further comprises a third BJT having a first current electrode coupled to the second current electrodes of the first BJT and the second BJT, and a second current electrode coupled at a second voltage supply terminal, and wherein the output driver circuit further comprises a fourth BJT having a first current electrode coupled to a control electrode and a second current electrode coupled at the second voltage supply terminal, the fourth BJT configured to form a current mirror with the third BJT.

7. The integrated circuit of claim 4, wherein the first BJT is configured to have an emitter area eight times the emitter area of the second BJT.

8. An integrated circuit comprising:

an output driver circuit configured to provide a first voltage at a first output terminal and a bandgap voltage at a first node, the output driver circuit comprising:

a first transistor having a first current electrode coupled at a first voltage supply terminal and a second current electrode coupled at the first output terminal;

a first resistor having a first terminal coupled at the first output terminal and a second terminal coupled at the first node; and a second resistor having a first terminal coupled at the first node;

an amplifier circuit coupled to the output driver circuit, the amplifier circuit configured to generate a PTAT current in a circuit branch of the output driver circuit, the amplifier circuit comprising:

a first BJT having a control electrode coupled to a second terminal of the second resistor;

a second BJT having a first current electrode coupled to a first current electrode of the first BJT and a second current electrode coupled at a second voltage supply terminal; and the circuit branch comprising a third BJT having a first current electrode and a control electrode coupled to a control electrode of the second BJT and a second current electrode coupled to the second voltage supply terminal; and a CTAT circuit coupled at the first node and configured to generate a CTAT current, the first voltage based on the PTAT current and the CTAT current through the first resistor.

9. The integrated circuit of claim 8, wherein the output driver circuit is configured such that the first voltage is higher than the bandgap voltage.

10. The integrated circuit of claim 8, wherein the amplifier circuit further comprises:

a current mirror comprising a first current branch and a second current branch, a first current electrode of the first BJT coupled at the first current branch; and a second BJT having a first current electrode coupled at the second current branch of the current mirror and a second current electrode coupled to a second current electrode of the first BJT.

11. The integrated circuit of claim 8, further comprising a level-shifter circuit coupled to the amplifier circuit and to the output driver circuit, the level-shifter circuit comprising:

a second transistor having a first current electrode coupled at the first voltage supply terminal, a control electrode coupled to receive a first bias voltage from the amplifier circuit, and a second current electrode coupled to a control electrode of the first transistor of the output driver circuit.

12. The integrated circuit of claim 11, wherein the level-shifter circuit further comprises a third transistor configured to generate a second bias voltage, and wherein the CTAT circuit comprises a fourth transistor coupled to receive the second bias voltage at a control electrode.

13. The integrated circuit of claim 12, wherein the CTAT circuit further comprises:

a first BJT having a first current electrode coupled at the first voltage supply terminal and a control electrode coupled at the first node; and a second resistor having a first terminal coupled at the control electrode of the first BJT and a second terminal coupled at a second current electrode of the first BJT and a first current electrode of the fourth transistor.

14. An integrated circuit comprising:

an output driver circuit configured to provide a first voltage at a first output terminal and a bandgap voltage at a first node, the output driver circuit comprising:

a first transistor having a first current electrode coupled at a first voltage supply terminal and a second current electrode coupled at the output terminal; and a first resistor having a first terminal coupled at the first output terminal and a second terminal coupled at the first node;

an amplifier circuit coupled to the output driver circuit, the amplifier circuit configured to generate a $\Delta V_{BE}$ voltage across a second resistor to form a PTAT current in a current branch of the output driver circuit, the amplifier circuit comprising:

a first BJT having a control electrode coupled to a second terminal of the second resistor;

a second BJT having a first current electrode coupled to a first current electrode of the first BJT and a second current electrode coupled at a second voltage supply terminal; and a third BJT having a first current electrode and a control electrode coupled to a control electrode of the second BJT and a second current electrode coupled to the second voltage supply terminal; and a CTAT circuit coupled at the first node and configured to generate a CTAT current, the first voltage based on the PTAT current and the CTAT current through the first resistor.

15. The integrated circuit of claim 14, wherein the output driver circuit is configured such that the first voltage is at least 100 mV higher than the bandgap voltage.

16. The integrated circuit of claim 14, further comprising a level-shifter circuit coupled to the amplifier circuit and to the output driver circuit, the level-shifter circuit comprising:

a second transistor having a first current electrode coupled at the first voltage supply terminal, a control electrode coupled to receive a first bias voltage from the amplifier circuit, and a second current electrode coupled to a control electrode of the first transistor of the output driver circuit.

17. An integrated circuit comprising:

an output driver circuit configured to provide a first voltage at a first output terminal, the output driver circuit comprising:

a first transistor having a first current electrode coupled at a first voltage supply terminal and a second current electrode coupled at the first output terminal; and a first resistor having a first terminal coupled at the first output terminal and a second terminal coupled at a first node;

a first circuit branch comprising:

a second resistor having a first terminal coupled at the first node and a second terminal coupled to a control electrode of the second BJT of the amplifier circuit at a second node; and a third resistor having a first terminal coupled at the second node and a second terminal coupled to a control electrode of the first BJT of the amplifier circuit at a third node;

an amplifier circuit coupled to the output driver circuit, the amplifier circuit configured to generate a PTAT current in the first circuit branch of the output driver circuit coupled at the first node, the amplifier circuit comprising:

a current mirror comprising a first current branch and a second current branch;

a first BJT having a first current electrode coupled at the first current branch of the current mirror; and a second BJT having a first current electrode coupled at the second current branch of the current mirror and a second current electrode coupled to a second current electrode of the first BJT; and a CTAT circuit configured to generate a CTAT current in a second circuit branch coupled at the first node.

18. An integrated circuit comprising:

an output driver circuit configured to provide a first voltage at a first output terminal, the output driver circuit comprising:

a first transistor having a first current electrode coupled at a first voltage supply terminal and a second current electrode coupled at the first output terminal;

a first resistor having a first terminal coupled at the first output terminal and a second terminal coupled at a first node; and a first BJT having a first current electrode coupled to a control electrode and a second current electrode coupled at a second voltage supply terminal;

an amplifier circuit coupled to the output driver circuit, the amplifier circuit configured to generate a PTAT current in the first circuit branch of the output driver circuit coupled at the first node, the amplifier circuit comprising:

a current mirror comprising a first current branch and a second current branch;

a second BJT having a first current electrode coupled at the first current branch of the current mirror;

a third BJT having a first current electrode coupled at the second current branch of the current mirror and a second current electrode coupled to a second current electrode of the second BJT; and a fourth BJT having a first current electrode coupled to the second current electrodes of the second BJT and the third BJT, and a second current electrode coupled at the second voltage supply terminal, the first BJT configured to form a current mirror with the fourth BJT; and a CTAT circuit configured to generate a CTAT current in a second circuit branch coupled at the first node.

19. An integrated circuit comprising:

an output driver circuit configured to provide a first voltage at a first output terminal and a bandgap voltage at a first node, the output driver circuit comprising:

a first transistor having a first current electrode coupled at a first voltage supply terminal and a second current electrode coupled at the first output terminal; and a first resistor having a first terminal coupled at the first output terminal and a second terminal coupled at the first node;

an amplifier circuit coupled to the output driver circuit, the amplifier circuit configured to generate a PTAT current in a circuit branch of the output driver circuit;

a level-shifter circuit coupled to the amplifier circuit and to the output driver circuit, the level-shifter circuit comprising:

a second transistor having a first current electrode coupled at the first voltage supply terminal, a control electrode coupled to receive a first bias voltage from the amplifier circuit, and a second current electrode coupled to a control electrode of the first transistor of the output driver circuit; and a third transistor configured to generate a second bias voltage; and a CTAT circuit coupled at the first node and configured to generate a CTAT current, the first voltage based on the PTAT current and the CTAT current through the first resistor, the CTAT circuit comprising:

a fourth transistor coupled to receive the second bias voltage at a control electrode.

* * * * *